US009582022B2

(12) United States Patent
Alkan et al.

(10) Patent No.: US 9,582,022 B2
(45) Date of Patent: Feb. 28, 2017

(54) DEVICE AND METHOD FOR GENERATING A CORRECTIVE MAGNETIC FIELD FOR FERRITE-BASED CIRCUITS

(71) Applicant: PPC Broadband, Inc., East Syracuse, NY (US)

(72) Inventors: Erdogan Alkan, Fayetteville, NY (US); Yan Li, Syracuse, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 385 days.

(21) Appl. No.: 14/222,235

(22) Filed: Mar. 21, 2014

(65) Prior Publication Data

US 2014/0285025 A1 Sep. 25, 2014

Related U.S. Application Data

(60) Provisional application No. 61/804,258, filed on Mar. 22, 2013.

(51) Int. Cl.
*H01F 13/00* (2006.01)
*G05F 7/00* (2006.01)

(52) U.S. Cl.
CPC ..... *G05F 7/00* (2013.01)

(58) Field of Classification Search
CPC ..... G05F 7/00
USPC ..... 307/101; 361/149
See application file for complete search history.

(56) References Cited

U.S. PATENT DOCUMENTS 3,845,358 A 10/1974 Anderson et al.
4,278,940 A * 7/1981 Milkovic ..... G01R 22/066 323/357
4,399,419 A 8/1983 Dobrovolny
5,334,955 A 8/1994 Strnad
5,686,838 A * 11/1997 van den Berg ..... B82Y 25/00 324/207.21
5,798,902 A 8/1998 Blodgett et al.
6,300,617 B1 10/2001 Daughton et al.
7,012,496 B2 3/2006 Sugiura et al.
7,061,355 B2 6/2006 Tanaka et al.
8,106,660 B1 1/2012 Merewether et al.
8,149,070 B2 4/2012 Albag et al.
8,368,500 B2 2/2013 Gilmartin et al.
2001/0050605 A1 12/2001 Sugiura et al.

(Continued)

FOREIGN PATENT DOCUMENTS

CN 201364801 12/2009
CN 102881401 1/2013

(Continued)

OTHER PUBLICATIONS

PCT/US14/31482; International Filing Date Mar. 21, 2014; International Search Report and Written Opinion; Date of Mailing Aug. 11, 2014; (26 pages).

(Continued)

*Primary Examiner* — Stephen W Jackson

(74) *Attorney, Agent, or Firm* — MH2 Technology Law Group, LLP

(57) ABSTRACT

A demagnetizing device includes, in one embodiment, a demagnetizer. The demagnetizer is operable to generate a corrective magnetic field. The corrective magnetic field is operable to act upon a ferrite-based core to maintain suitable performance of a network-connected device which includes such core.

20 Claims, 13 Drawing Sheets

(56) References Cited

U.S. PATENT DOCUMENTS

| | | | |
|---|---|---|---|
| 2004/0113742 | A1 | 6/2004 | Tanaka et al. |
| 2010/0079218 | A1 | 4/2010 | Albag et al. |
| 2012/0212305 | A1 | 8/2012 | Shafer |
| 2013/0015848 | A1 | 1/2013 | Govari et al. |

FOREIGN PATENT DOCUMENTS

| | | | |
|---|---|---|---|
| WO | 2010/035264 | A1 | 4/2010 |
| WO | 2013/074705 | A2 | 5/2013 |

OTHER PUBLICATIONS

Wang Runnan (Examiner), Chinese Office Action dated Nov. 4, 2016, CN Application No. 201480029303.4, filed Mar. 21, 2014, pp. 1-15 (including English Translation).

* cited by examiner

DEVICE AND METHOD FOR GENERATING A CORRECTIVE MAGNETIC FIELD FOR FERRITE-BASED CIRCUITS

PRIORITY CLAIM

This application is a non-provisional of, and claims the benefit and priority of, U.S. Provisional Patent Application No. 61/804,258, filed on Mar. 22, 2013. The entire contents of such application are hereby incorporated by reference.

BACKGROUND

In data networks, there is sometimes the need to include ferrite-based devices, such as network-connected devices having electrical transformers. Such a transformer has a ferrite core surrounded by coil windings. In regular operation of the transformer, the ferrite core maintains a relatively neutral or demagnetized state. However, from time to time, transient electrical current can flow through the data network, passing through the network-connected device. In time, the transient current can cause the ferrite core to become magnetized as a permanent or semi-permanent magnet.

When the ferrite core is magnetized, the ferrite core can produce a problematic magnetic field. For example, CATV networks have high bandwidths operable over a wide spectrum of frequencies to distribute RF data signals. The problematic magnetic field can cause various problems such as different RF frequencies resulting in frequency interference, spurious intermodulation effects that decrease available bandwidth in the circuit, a loss in signal strength and quality, and noise in the data network.

Therefore, there is a need to overcome, or otherwise lessen the effects of, the disadvantages and shortcomings described above.

SUMMARY

The present disclosure relates, in one embodiment, to radio frequency (RF) circuits and, more particularly, to a magnetic field generator or demagnetizing device for conditioning a ferrite component in a circuit. The present disclosure provides, in one embodiment, a structure for use with RF components that offers improved performance.

In one embodiment, the demagnetizing device includes a circuit configured to be operatively coupled to, or incorporated into, an electrical apparatus such as a data network-connected device. The network-connected device has a first circuit portion, or signal path, and at least one component, such as a ferrite core or iron core. The network-connected device is electrically connected to a coaxial cable, and the coaxial cable is electrically connected to a data network. The first circuit portion is configured to receive a first parallel part of a transient signal transmission. The first parallel part of the transient signal transmission is operable to problematically magnetize the component. The problematic magnetization would cause the performance of the network-connected device to drop from a designated performance level to a lower performance level.

The demagnetizing device also includes a second circuit portion, or signal path, and a demagnetizer. The second circuit portion is configured to receive a second parallel part of the transient signal transmission in parallel with the first circuit portion receiving the first parallel part of the transient signal transmission. The demagnetizer is configured to operate based on the second parallel part of the transient signal.

In one embodiment, the second parallel part of the transient signal flows through the demagnetizer causing the demagnetizer to generate a corrective magnetic field. The operation of the demagnetizing device causes a continuous reduction in the problematic magnetization of the network-connected device so that its performance is maintained to be at least as good as the designated performance level. In one embodiment, the corrective magnetic field counteracts the problematic magnetic field.

In one embodiment, the present disclosure provides an RF circuit comprising a splitter transformer. The splitter transformer has a ferrite core and a magnetic field generator conditioning the ferrite core. The ferrite core is located within a magnetic field of the magnetic field generator.

In another embodiment, a circuit includes a first component that is subject to a degradation effect caused by a transient signal received by the first component. A second component of the circuit is configured to receive the transient signal and to emit a counteracting signal in response to receiving the transient signal. The counteracting signal causes a reduction in the degradation effect in the first component.

Additional features and advantages of the present disclosure are described in, and will be apparent from, the following Brief Description of the Drawings and Detailed Description.

DETAILED DESCRIPTION

Figure 1A:
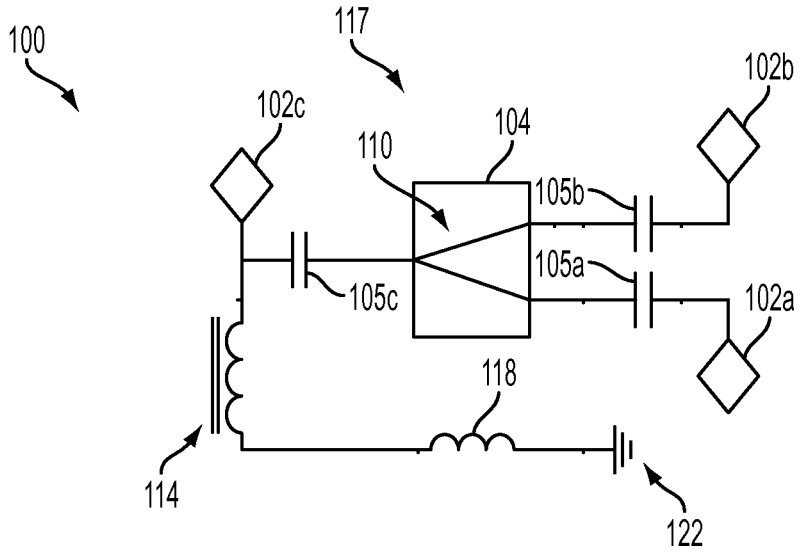
FIG. 1A is a schematic view of a radio frequency (RF) circuit, in accordance with embodiments of the present disclosure.

Although certain embodiments of the present disclosure will be shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., which are disclosed simply as an example of an embodiment. The features and advantages of the present disclosure are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

Referring now to the drawings, wherein like reference numerals refer to like parts throughout, FIG. 1A illustrates a schematic view of a circuit 100, such as a radio frequency (RF) circuit, which may be included in an electrical device. Depending upon the embodiment, the electrical device can be a CATV cable splitter or an isolator device operable to break the grounding circuit running through the outer conductor of a coaxial cable.

In one embodiment, RF circuit 100 may include ports 102*a*, 102*b*, and 102*c*. Port 102*a* may be referred to herein as an input data port which receives signals over a CATV transmission line, and ports 102*b* and 102*c* may be referred to as output data ports which output the CATV transmission to two or more attached devices, as described below. The attached devices may be located within a home or other venue if the circuit 100 is used therein or the attached devices may comprise a distribution box (FIG. 7, #32) if the circuit 100 is used in an outdoor environment.

Figure 15:
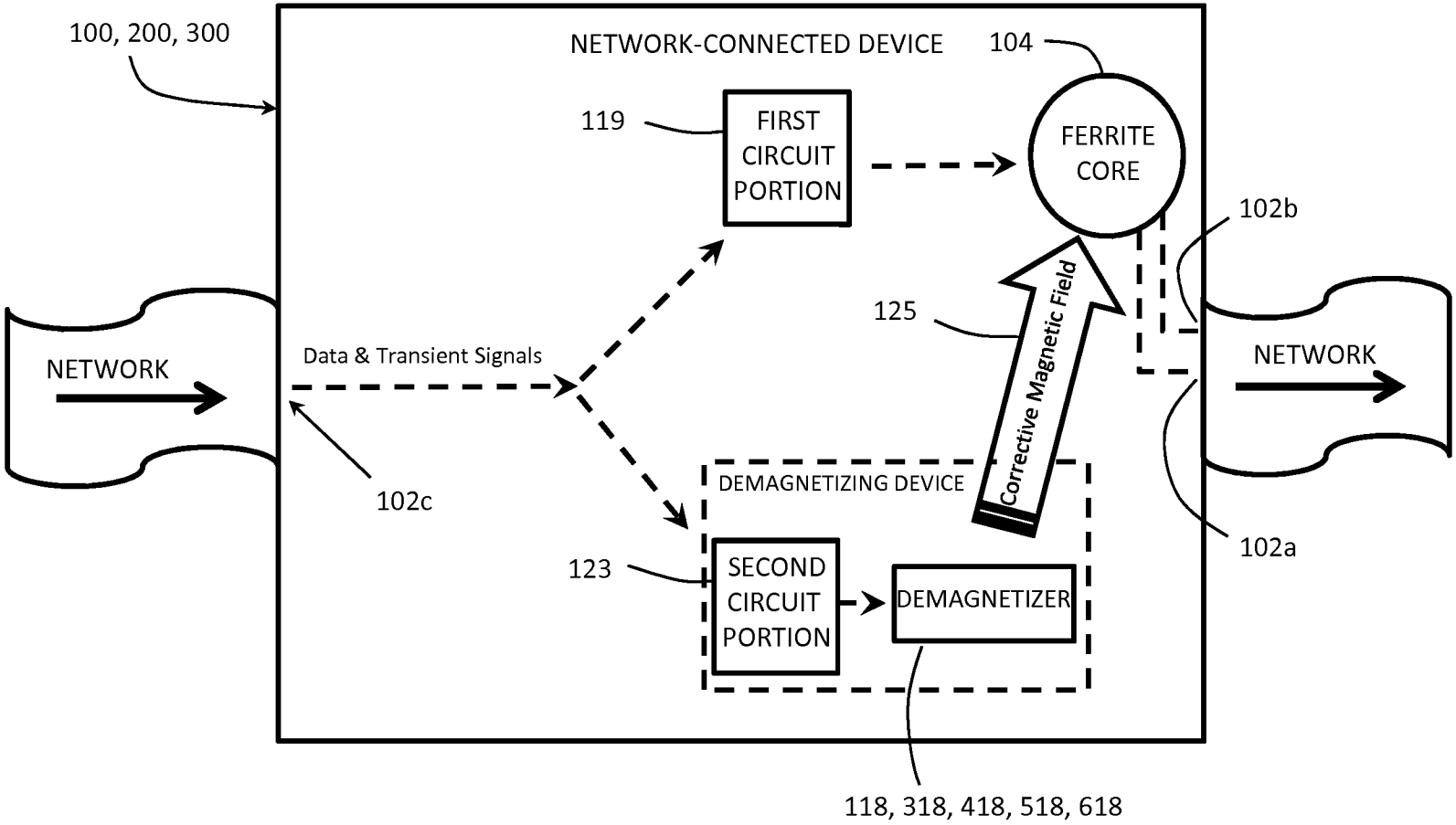
FIG. 15 is a functional diagram depicting operation of an RF circuit in accordance with RF circuit embodiments of the present disclosure.

Also included in circuit 100 are capacitors 105*a*, 105*b*, and 105*c*, a choke component 114 having inductive properties, a splitter transformer 117 which includes a ferrite core 104 and conductive windings 110, and a magnetic field generator, or demagnetizing device 118. Capacitor 105*c* and choke 114 are connected in parallel to the input data port 102*c*. In turn, capacitor 105*c* is connected in series to splitter transformer 117 and the choke 114 is connected in series to grounded demagnetizing device 118. The demagnetizing coil or demagnetizing device 118 is connected to the ground 122. Windings 110 in the splitter transformer 117 are connected in parallel to the capacitor 105*c* and are each connected to one capacitor, either 105*a* or 105*b*. Capacitors 105*a* and 105*b*, in turn, are connected to output data ports 102*a* and 102*b*, respectively. The input data port 102*c* parallel connection to capacitor 105*c* may comprise a first receiving section of the RF circuit 100, such as the first circuit portion, or first path, 119 as shown in FIG. 15. Similarly, the input data port 102*c* parallel connection to choke 114 may comprise a second receiving section of the RF circuit 100, such as the second circuit portion, or path 123, as shown in FIG. 15.

In one embodiment, the demagnetizing device 118 is configured to continuously reset or condition the ferrite core 104 by subjecting it to a magnetic field. Thus, in this embodiment, conditioning the ferrite core 104 includes subjecting the ferrite core 104 to a demagnetizing magnetic field generated by the demagnetizing device 118. Put another way, the demagnetizing device 118 generates a corrective magnetic field that counteracts the problematic magnetization, or magnetic field, of the ferrite core 104. Such demagnetization results in improved performance of the ferrite core 104 by decreasing its magnetization and reducing intermodulation effects caused by accumulating magnetization therein. The demagnetizing device 118 may include any type of magnetic field generator including, among other things, a demagnetizing coil, a permanent magnet, or other suitable magnetic field source.

Figure 1B:
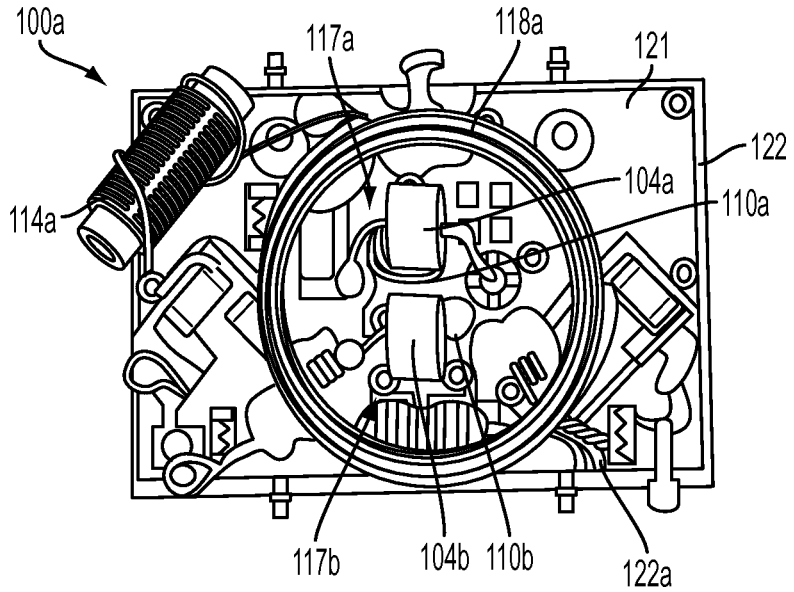
FIG. 1B is a perspective view of an alternative RF circuit from the circuit of FIG. 1A, in accordance with embodiments of the present disclosure.

RF circuit 100 and 100*a*, as illustrated in FIGS. 1A and 1B, respectively, enables correction of degradation undergone by ferrite core 104 that results from transient signals. In operation, transient signals can be caused by lightning surge, energy storage issues associated with capacitive transmission lines such as varying frequency signals, additional power circuits within an RF system, switching arcs, electrostatic discharge, and other spurious phenomena. Such transient signals are random, unintentional, non-data carrying signals. It should be appreciated that a transient signal can include an RF signal which disappears as soon as it has completed its transmission, or flow, through a circuit, including, but not limited to, a nonperiodic signal of short duration.

The RF circuit 100 filters some spurious, transient signals to improve intermodulation effects in the circuit. However, some of the transient signals are not filtered. The flow of the unfiltered signals gradually or incrementally magnetizes the ferrite core 104. At the same time, the demagnetizing device 118 receives some of the unfiltered signals, and the demagnetizing device uses those unfiltered signals to generate a magnetic field. Before the ferrite core 104 reaches a threshold level of problematic magnetization associated with poor performance, the demagnetizing device 118 decreases the magnetization level of the core 104 by affecting the core 104 with the magnetic field. The demagnetizing device 118 generates a corrective magnetic field that counteracts the problematic magnetic field of the ferrite core 104. In other words, the demagnetizing device 118 constantly or continuously prevents the ferrite core 104 from reaching the threshold level of problematic magnetization associated with poor performance by applying its corrective magnetic field to the core 104, a magnetic field induced by the unfiltered transient signals themselves.

A transient signal received at input port 102*c* may be transmitted through capacitor 105*c* and through ferrite core 104, affecting it by incrementally magnetizing it with each occurrence of a transient signal. In order to counteract the harmful effects of magnetization, demagnetizing device 118 may be placed over or adjacent to ferrite core 104. The demagnetizing device 118 is connected to the input port 105*c* in parallel with the ferrite core 104, via the choke 114, and also receives the transient signal which is transmitted therethrough to ground 122. Due to the lag time induced in the transient signal transmitted through the choke 114 and the demagnetizing device 118, the magnetic field generated by the demagnetizing device 118 peaks after the transient signal has passed through the ferrite core 104. Thus, demagnetizing device 118 acts to continuously reset, condition, or demagnetize the ferrite core 104 at a time after the magnetizing transient signal has passed through the ferrite core 104. When spurious transient signals are not present, the demagnetizing coil 118 acts as a passive circuit. When transient signals are present, the demagnetizing coil generates a magnetic field (i.e., demagnetizing ferrite core 104) configured to remove or counteract the magnetizing degradation effects of the transient signals upon the ferrite core 104. Therefore, circuit 100 conditions and resets itself every time the transient signals enter circuit 100.

The ferrite core 104 of the splitter transformer 117 may include multiple ferrite material types arranged in a non-uniform manner (e.g., variably permeable). The windings 110 may be in physical contact with an interior and/or an exterior surface of ferrite core 104. The splitter transformer 117 may be formed such that air gaps are formed between the windings 110 and an exterior surface of ferrite core 104. The gaps serve to electrically and physically separate the windings 110 from the exterior surface of the ferrite core 104. In one embodiment, spacers may be placed between the windings 110 and ferrite core 104. The spacers also serve to electrically and physically separate the windings 110 from the exterior surface of the ferrite core 104. In another embodiment, the ferrite core 104 may include an electrically insulative material formed over an exterior surface of ferrite core 104. The electrically insulative material serves to electrically and physically separate the windings 110 from the exterior surface of the ferrite core 104. The windings 110 may include a plurality of turns of a relatively fine gauge insulated wire (e.g., copper) wound on the ferrite core 104 having a preselected number of turns and orientation. Splitter transformer 117 may include any of a plurality of shapes such as, inter alia, a circular shape, a cylindrical shape, a rectangular shape, or other suitable geometric shape.

Referring further to FIG. 1B, there is illustrated an RF circuit 100*a* produced according to the schematic circuit configuration 100 of FIG. 1A except that, in an alternative embodiment, two splitter transformers 117*a* and 117*b* may be implemented in the RF circuit 100*a*, each including one ferrite core 104*a* and 104*b*, respectively. Either of the two splitter transformers may be referred to as a matching transformer. Each ferrite core 104*a*, 104*b* comprises windings 110*a*, 110*b*, respectively. RF circuit 100*a* includes a demagnetizing device 118*a* (demagnetizing coil) configured to envelop ferrite cores 104*a* and 104*b* in a magnetic field generated by the transient signals transmitted through demagnetizing coil 118*a* and thereby condition ferrite cores 104*a* and 104*b*. The choke component 114*a* is configured to shunt the transient signals to the demagnetizing coil 118*a*. The demagnetizing coil generates a magnetic field induced by the transient signals being transmitted therethrough and serves continuously to reset or condition the ferrite cores 104*a* and 104*b*, as described above. The components of RF circuit 100*a* may be disposed on a generally planar printed circuit board (PCB) 121 which, in turn, is enclosed in a housing 122.

Figure 2A:
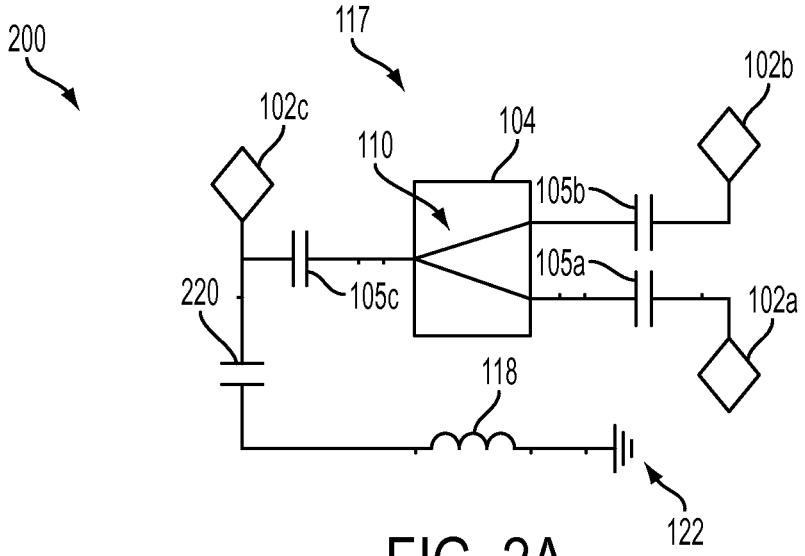
FIG. 2A is a schematic view of an alternative RF circuit from the RF circuit of FIG. 1A, in accordance with embodiments of the present disclosure.
Figure 2B:
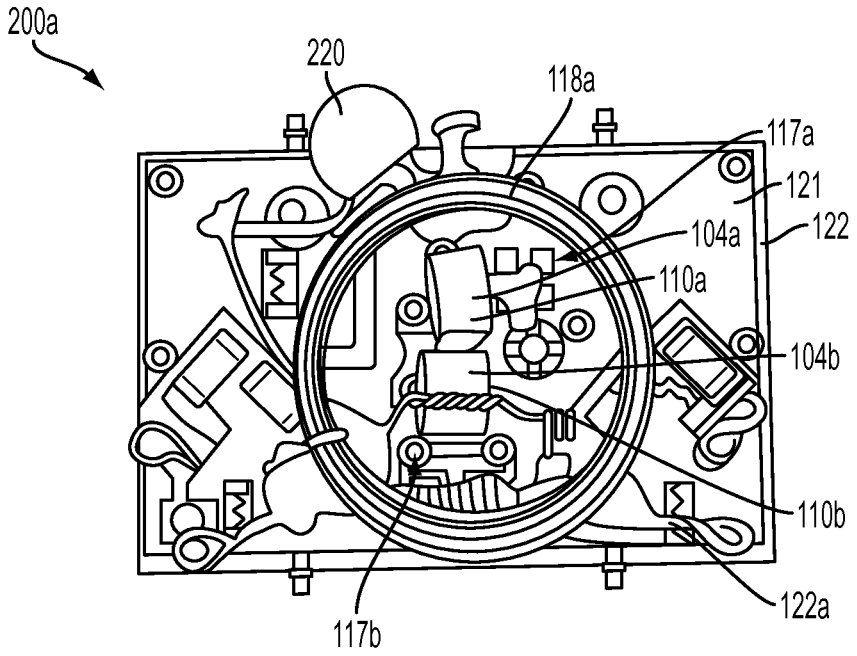
FIG. 2B is a perspective view of an alternative RF circuit from the circuit of FIG. 2A, in accordance with embodiments of the present disclosure.

Referring to FIG. 2A, there is illustrated a schematic RF circuit 200 which operates as described above with reference to FIG. 1A except that the choke 114 has been replaced with a spark gap component 220 having capacitive properties. Spark gap component 220 is configured to shunt transient signals to the demagnetizing device 118. Referring further to FIG. 2B, there is illustrated an RF circuit 200*a* produced according to the schematic circuit configuration 200 of FIG. 2A except that, in an alternative embodiment, two splitter transformers 117*a* and 117*b* may be implemented in the RF circuit 200*a*, each including one ferrite core 104*a* and 104*b*, respectively. Each ferrite core 104*a*, 104*b* comprises windings 110*a*, 110*b*, respectively. RF circuit 200*a* illustrates the spark gap component 220 replacing choke component 114*a* (FIG. 1B). The capacitor 105*c* and spark gap component 220 are configured to shunt the transient signals to the demagnetizing device 118. As described above with reference to the RF circuit 100, demagnetizing device 118 generates a magnetic field (#125 FIG. 15), caused by the transient signals being transmitted therethrough, which envelops the ferrite cores 104*a* and 104*b*, thereby resetting or conditioning them. The input data port 102*c* parallel connection to capacitor 105*c* may comprise a first receiving section of the RF circuit 200, such as the first circuit portion, or path, 119 as shown in FIG. 15. Similarly, the input data port 102*c* parallel connection to spark gap 220 may comprise a second receiving section of the RF circuit 200, such as the second circuit portion, or path, 123 as shown in FIG. 15. The circuit components of RF circuit 200*a* may be disposed on a generally planar PCB 121 which, in turn, is enclosed in a housing 122.

Figure 3B:
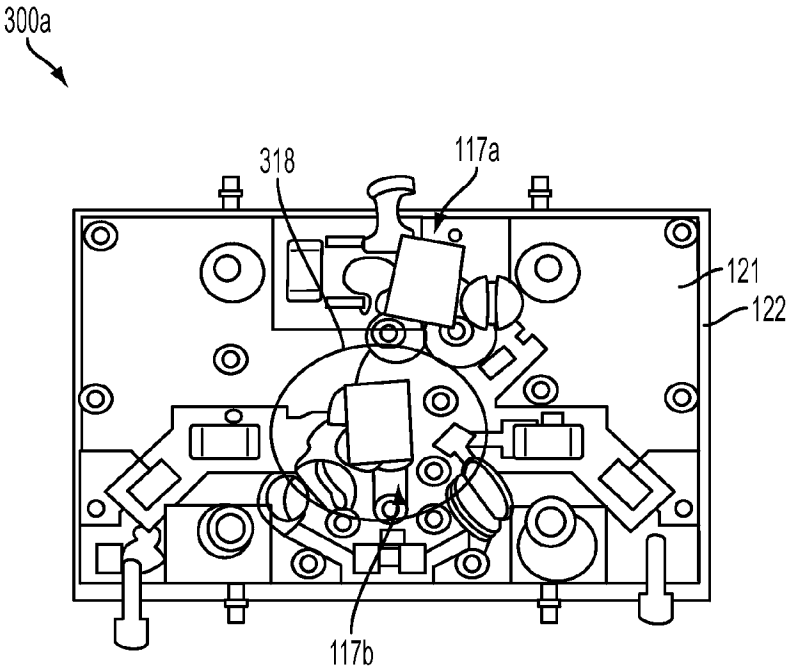
FIG. 3B is a perspective view of an alternative RF circuit from the circuit of FIG. 3A, in accordance with embodiments of the present disclosure.
Figure 3A:
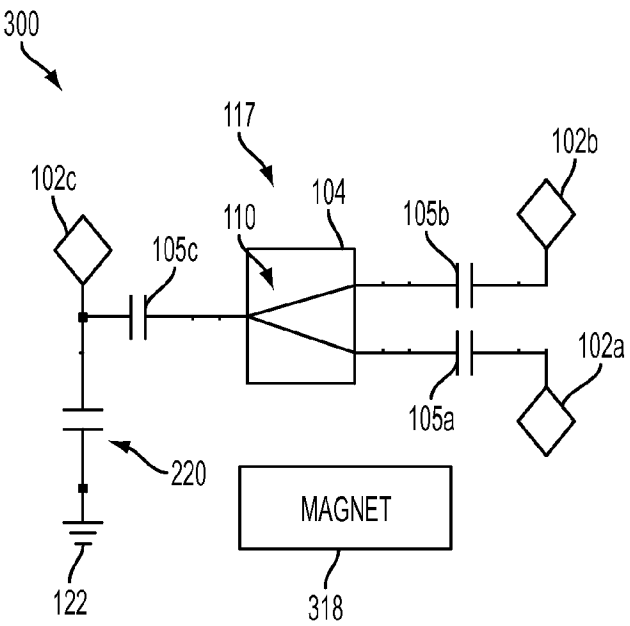
FIG. 3A is a schematic view of an alternative RF circuit from the RF circuit of FIG. 2A, in accordance with embodiments of the present disclosure.

Referring further to FIG. 3A, there is illustrated a schematic RF circuit 300, which operates as described above with reference to FIG. 2A except that the spark gap 220 is connected to ground 122 instead of the demagnetizing device 118, and the demagnetizing device 118 is replaced with a permanent magnet 318 in this embodiment. The magnet 318 generates a continuous magnetic field configured to envelop ferrite core 104 by being placed adjacent to ferrite core 104. A placement location for magnet 318 may vary. For example, with reference to FIG. 3B, magnet 318 may be placed on the PCB 121 under the splitter transformer 117*b* or, alternatively, magnet 318 may be placed over a splitter transformer in order to generate a magnetic field for resetting or conditioning the ferrite core 104. FIG. 3B illustrates an image of an RF circuit 300*a* produced according to the schematic circuit configuration 300 of FIG. 3A except that, in an alternative embodiment, two splitter transformers 117*a* and 117*b* may be implemented in the RF circuit 300*a*, similar to the implementation described above with respect to FIG. 2B. With reference to FIG. 3A, the input data port 102*c* parallel connection to capacitor 105*c* may comprise a first receiving section of the RF circuit 300, such as the first circuit portion, or path, 119 as shown in FIG. 15. Similarly, the input data port 102*c* parallel connection to grounded spark gap 220 may comprise a second receiving section of the RF circuit 300, such as the second circuit portion, or path, 123 as shown in FIG. 15. In the embodiment of the RF circuit 300, a parallel portion of the transient signal is not transmitted into the demagnetizing device comprising permanent magnet 318. The circuit components of RF circuit 300*a* may be disposed on a generally planar PCB 121 which, in turn, is enclosed in a housing 122.

FIGS. 4A-4D, 5A-5D, and 6A-6D, illustrate a schematic perspective view of three possible orientations of the demagnetizing device 118 with respect to the ferrite components 104*a* and 104*b*, respectively, in either of the RF circuit embodiments 100 and 200 disclosed herein. Although three exemplary relative orientations are illustrated, other relative placements of the demagnetizing device 118 with respect to the ferrite components 104*a* and 104*b* may be possible and are not limited by these exemplary embodiments. Referring further to the illustration of FIGS. 4A-4D, 5A-5D, and 6A-6D, the magnetic field generator 418, 518, 618, and ferrite components 404*a*-404*b*, 504*a*-504*b*, and 604*a*-604*b* will be describe with orientations defined by coordinate axes XYZ 460, 560, 660, respectively, in relation to the PCB 450, 550, 650, respectively. As illustrated in these figures, the PCB is disposed in an XY plane, and the Z axis is perpendicular thereto.

Figure 4A:
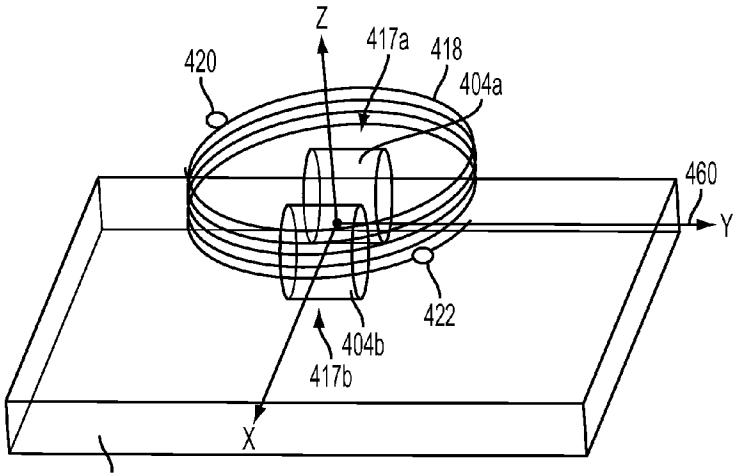
FIGS. 4A-4D are perspective views illustrating relative position of a magnetic field generator with respect to ferrite cores of splitter transformers, in accordance with embodiments of the present disclosure.
Figure 4B:
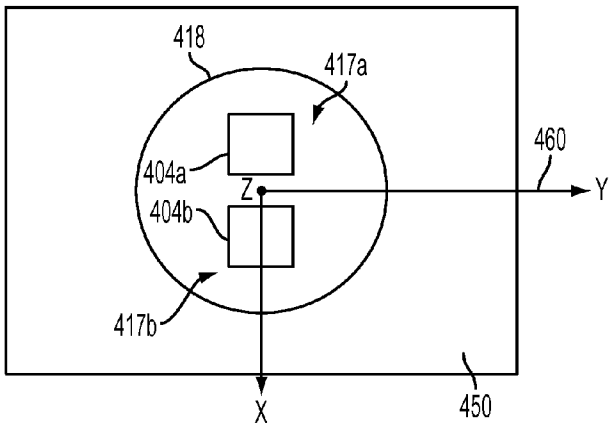
Figure 4C:
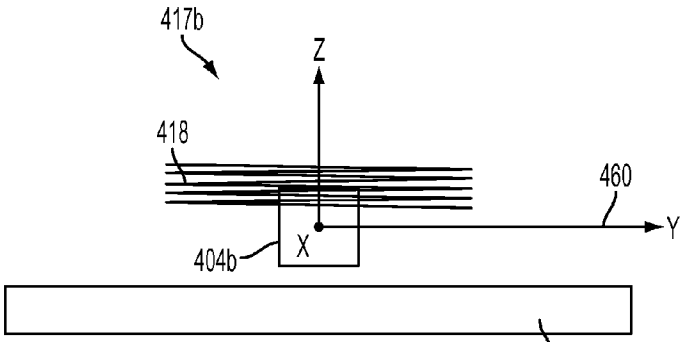
Figure 4D:
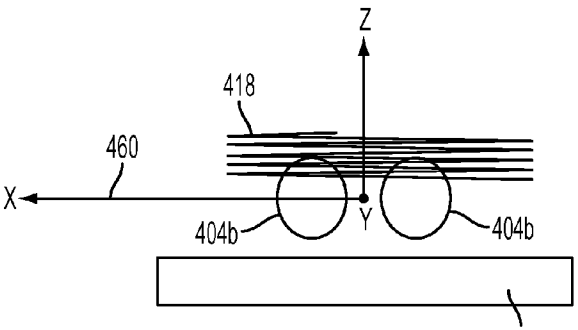

With respect to FIGS. 4A-4D, FIG. 4A illustrates a perspective view of the demagnetizing device or demagnetizing device 418 in a first orientation with respect to ferrite components 404*a* and 404*b* and the PCB 450. FIG. 4B illustrates a top view of FIG. 4*a*; FIG. 4C illustrates a front view of FIG. 4A; and FIG. 4D illustrates a side view of FIG. 4A. In a first relative orientation, the demagnetizing device 418 may be defined as occupying a plane parallel to the XY plane of the PCB 450. Additionally, FIG. 4A illustrates the magnetic field generator 418 connected to a choke or spark gap component 420 and a ground 422. Referring further to FIG. 4B, the top view illustrates a relative position of the demagnetizing device 418 with respect to ferrite cores 404*a* and 404*b* wherein the ferrite cores 404*a* and 404*b* are disposed within the generally circular outline of the demagnetizing device 418 which ensures that the generated magnetic field will envelop the ferrite components 404*a* and 404*b*. Referring further to FIG. 4C, the front view illustrates a relative position of the demagnetizing device 418 with respect to ferrite cores 404*a* and 404*b* wherein the demagnetizing coil 418 occupies a plane parallel to the plane of the PCB 450 and is disposed above the PCB 450 slightly higher than the ferrite cores 404*a* and 404*b*. Referring further to FIG. 4D, the side view illustrates a relative position of a demagnetizing device 418 with respect to ferrite cores 404*a* and 404*b* wherein the ferrite cores 404*a* and 404*b* are disposed within the width of the demagnetizing device 418.

Figure 5B:
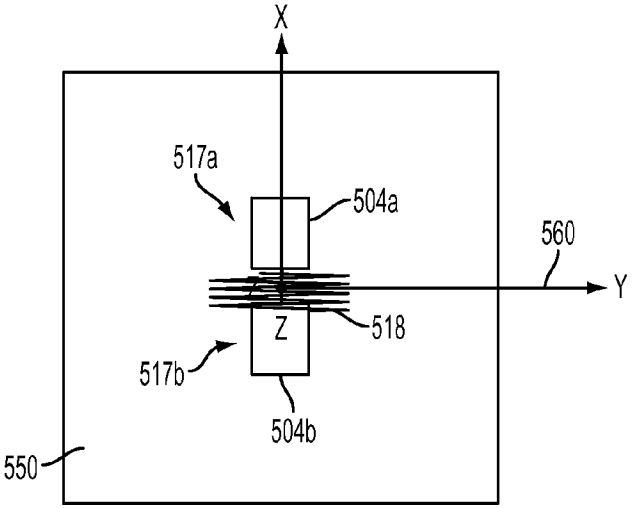
FIGS. 5A-5D are first alternative perspective views illustrating relative position of a magnetic field generator with respect to ferrite cores of splitter transformers, in accordance with embodiments of the present disclosure.
Figure 5D:
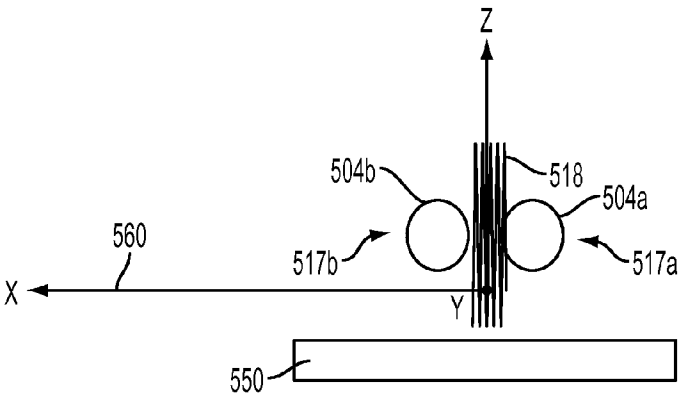
Figure 5A:
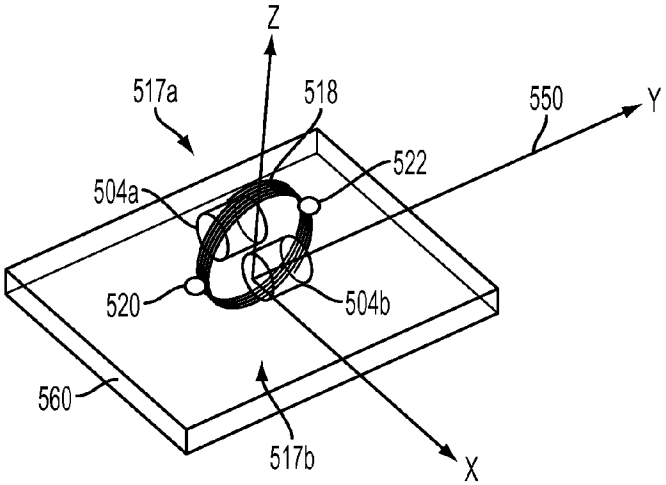
Figure 5C:
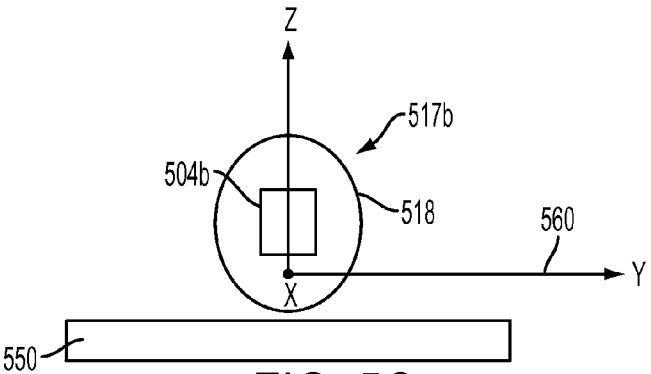

With respect to FIGS. 5A-5D, FIG. 5A illustrates a perspective view of the demagnetizing device or demagnetizing device 518 in a first orientation with respect to ferrite cores 504*a* and 504*b* and the PCB 550. FIG. 5B illustrates a top view of FIG. 5*a*; FIG. 5C illustrates a front view of FIG. 5A; and FIG. 5D illustrates a side view of FIG. 5A. In a second relative orientation, the demagnetizing device 518 may be defined as occupying a plane parallel to the YZ plane of the XYZ coordinates 560 and is perpendicular to the plane occupied by the PCB 550. Additionally, FIG. 5A illustrates the magnetic field generator 518 connected to a choke or spark gap component 520 and a ground 522. Referring further to FIG. 5B, the top view illustrates a relative position of the demagnetizing device 518 with respect to ferrite cores 504*a* and 504*b* wherein the ferrite cores 504*a* and 504*b* are disposed on opposite sides of the demagnetizing device 518. Referring further to FIG. 5C, the front view illustrates a relative position of the demagnetizing device 518 with respect to ferrite cores 505*a* and 505*b* wherein the ferrite cores 504*a* and 505*b* are disposed within the generally circular profile of the demagnetizing device 518 which ensures that the generated magnetic field will envelop the ferrite components 504*a* and 504*b*. Referring further to FIG. 5D, the side view illustrates a relative position of the demagnetizing device 518 with respect to ferrite cores 504*a* and 504*b* wherein the ferrite cores 504*a* and 504*b* are disposed on opposite sides of the demagnetizing device 518 at a height above the PCB that is approximately in the middle of the height of the demagnetizing device 518.

Figure 6A:
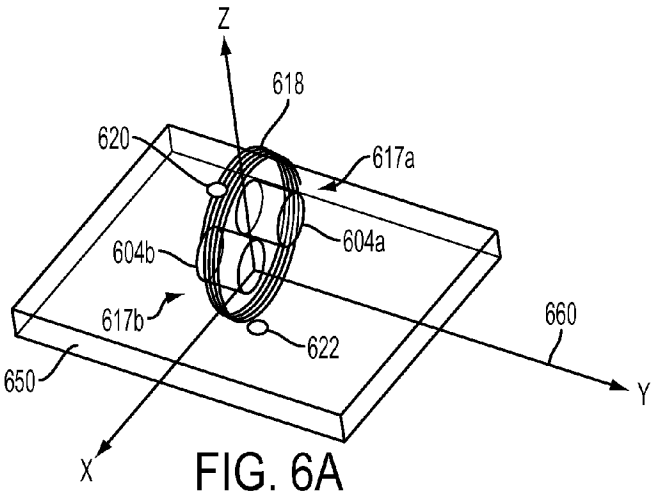
FIGS. 6A-6D are second alternative perspective views illustrating relative position of a magnetic field generator with respect to ferrite cores of splitter transformers, in accordance with embodiments of the present disclosure.
Figure 6B:
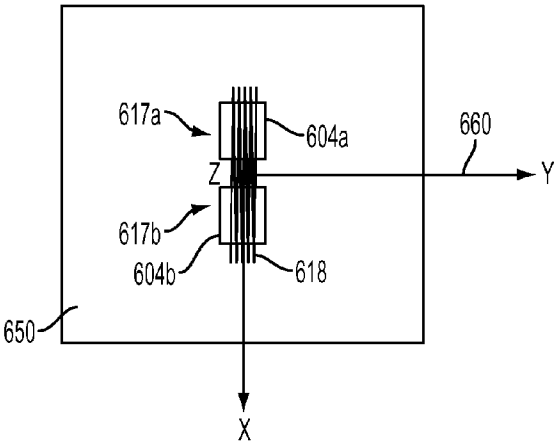
Figure 6C:
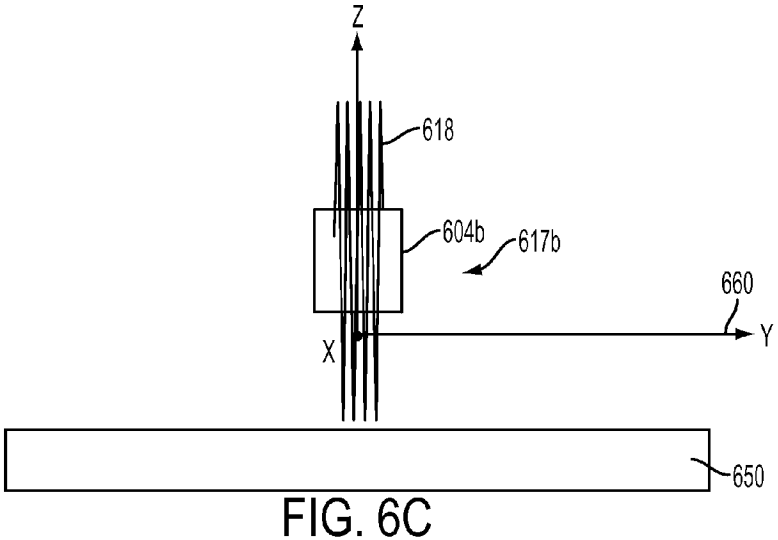
Figure 6D:
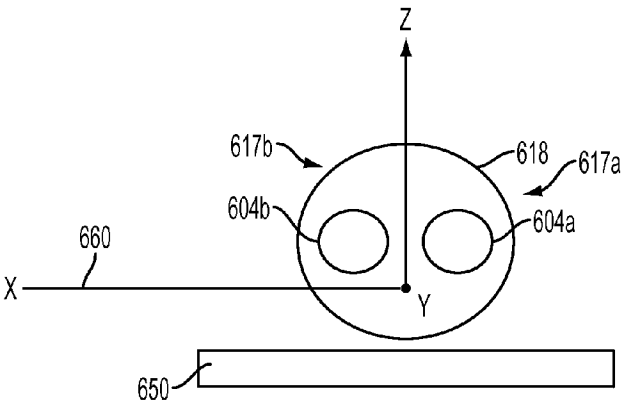

With respect to FIGS. 6A-6D, FIG. 6A illustrates a perspective view of the magnetic field generator or demagnetizing device 618 in a third relative orientation with respect to ferrite cores 604*a* and 604*b* and the PCB 650. FIG. 6B illustrates a top view of FIG. 6*a*; FIG. 6C illustrates a front view of FIG. 6A; and FIG. 6D illustrates a side view of FIG. 6A. In the third relative orientation, the demagnetizing device 618 may be defined as occupying a plane parallel to the XZ plane of the XYZ coordinates 660 and is perpendicular to the plane occupied by the PCB 650. Additionally, FIG. 6A illustrates the magnetic field generator 618 connected to a choke or spark gap component 620 and a ground 622. Referring further to FIG. 6B, the top view illustrates a relative position of the demagnetizing device 618 with respect to ferrite cores 604*a* and 604*b* wherein the ferrite cores 604*a* and 604*b* are disposed within the dimensions of the demagnetizing device 618. Referring further to FIG. 6C, the front view illustrates a relative position of the demagnetizing device 618 with respect to ferrite cores 604*a* and 604*b* wherein the ferrite cores 604*a* and 606*b* are disposed at a height above the PCB 650 approximately in the middle of the height of the demagnetizing device 618. Referring further to FIG. 6D, the side view illustrates a relative position of the demagnetizing device 618 with respect to ferrite cores 604*a* and 604*b* wherein the ferrite cores 604*a* and 604*b* are disposed within the generally circular profile of the demagnetizing device 618 which ensures that the generated magnetic field will envelop the ferrite cores 604*a* and 604*b*.

FIG. 15 illustrates the functional operation of the RF circuit embodiments described above. The RF circuit embodiments 100, 200, 300 may be connected into a CATV data signal receiving system wherein incoming transient signals (non-data signals) are received at input data port 102*c* and a parallel portion is transmitted in parallel to each of a first circuit portion (first path) 119 and a second circuit portion (second path) 123. The first circuit portion 119 may comprise a ferrite core 104 that is magnetized by one parallel portion of the transient signals, which is a problematic and degrading magnetization with respect to circuit performance of the ferrite core. The second circuit portion 125 may comprise a demagnetizer, such as the demagnetizer embodiments 118, 318, 418, 518, 618, described herein, which receives another parallel portion of the transient signals. The demagnetizer emits a corrective magnetic field 125, induced by the parallel portion of the transient signals being transmitted therethrough, which magnetic field 125 passes into and envelops the ferrite core 104 and acts to counteract the problematic magnetization of the ferrite core 104 by serving to demagnetize or at least decrease the magnetization of the ferrite core 104.

Figure 7:
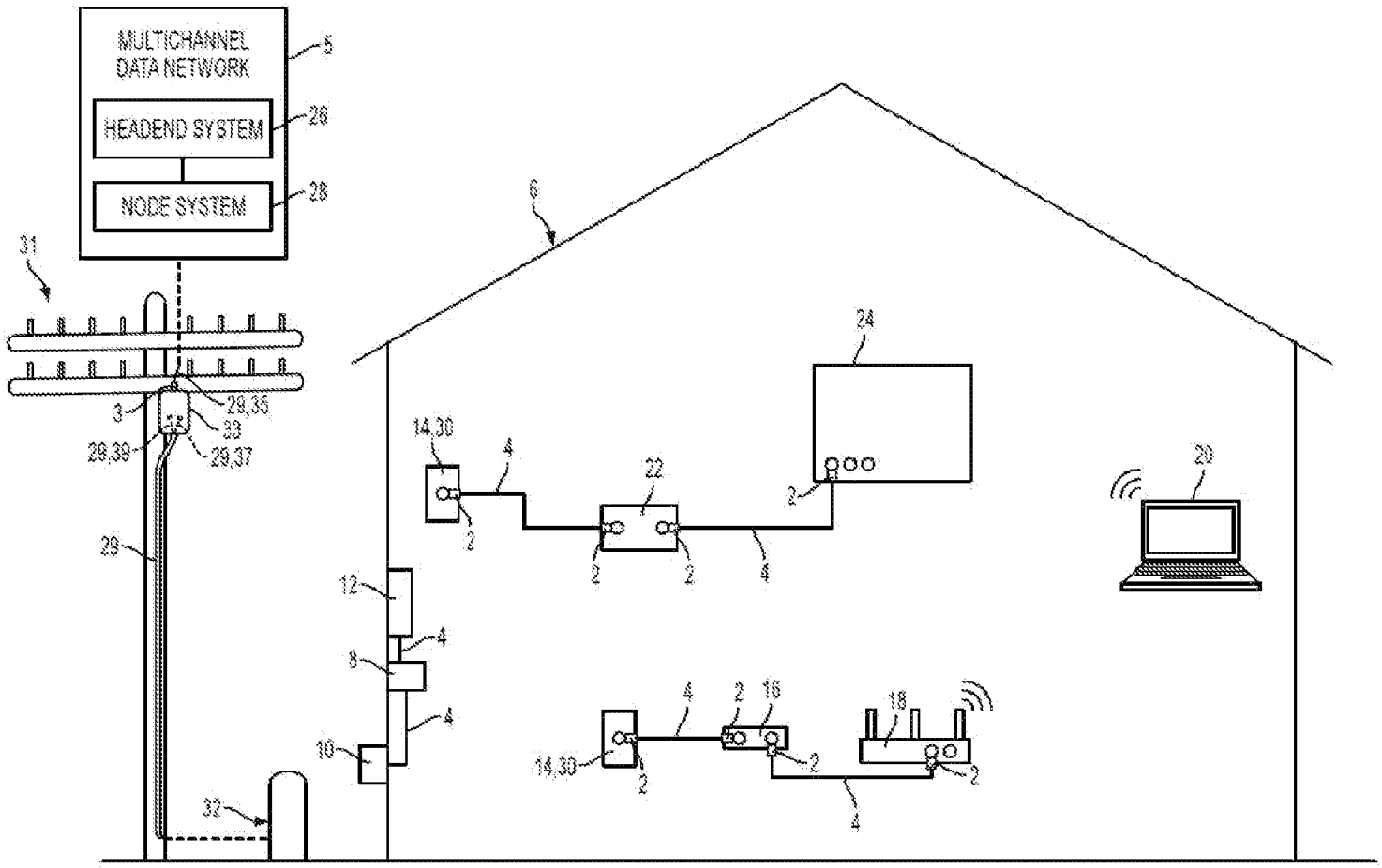
FIG. 7 is a schematic diagram illustrating an environment coupled to a multichannel data network.

Referring to FIG. 7, cable connectors 2 and 3 enable the exchange of data signals between a broadband network or multichannel data network 5, and various devices within a home, building, venue or other environment 6. For example, the environment's devices can include: (a) a point of entry ("PoE") filter 8 operatively coupled to an outdoor cable junction device 10; (b) one or more signal splitters comprising any of the splitter transformer 117 embodiments, described herein in relation to FIGS. 1A-6D, which may be disposed within a service panel 12 which distributes the data service to interface ports 14 of various rooms or parts of the environment 6; (c) a modem 16 which modulates radio frequency ("RF") signals to generate digital signals to operate a wireless router 18; (d) an Internet accessible device, such as a mobile phone or computer 20, wirelessly coupled to the wireless router 18; and (e) a set-top unit 22 coupled to a television ("TV") 24. In one embodiment, the set-top unit 22, typically supplied by the data provider (e.g., the cable TV company), includes a TV tuner and a digital adapter for High Definition TV.

In one distribution method, the data service provider operates a headend facility or headend system 26 coupled to a plurality of optical node facilities or node systems, such as node system 28. The data service provider operates the node systems as well as the headend system 26. The headend system 26 multiplexes the TV channels, producing light beam pulses which travel through optical fiber trunklines. The optical fiber trunklines extend to optical node facilities in local communities, such as node system 28. The node system 28 translates the light pulse signals to RF electrical signals. The RF electrical signal may be subject to transient spurious signals generated by sources as described herein and which may be transmitted into the home, building, venue or other environment 6 via the service panel 12.

In one embodiment, a drop line coaxial cable or weather-protected or weatherized coaxial cable 29 is connected to the headend facility 26 or node facility 28 of the service provider. In the example shown, the weatherized coaxial cable 29 is routed to a standing structure, such as utility pole 31. A splitter or entry junction device 33 is mounted to, or hung from, the utility pole 31. In the illustrated example, the entry junction device 33 includes an input data port or input tap for receiving a hardline connector or male-type connector 3. The entry junction box device 33 also includes a plurality of output data ports within its weatherized housing. It should be appreciated that such a junction device can include any suitable number of input data ports and output data ports and may also include signal splitters comprising any of the splitter transformer 117 embodiments, described herein in relation to FIGS. 1A-6D, which may be disposed within the junction box device 33.

The end of the weatherized coaxial cable 35 is attached to a hardline connector or male-type connector 3. The ends of the weatherized coaxial cables 37 and 39 are each attached to one of the female-type connectors 2 described below. In this way, the connectors 2 and 3 electrically couple the cables 35, 37 and 39 to the junction device 33.

In one embodiment, the male-type connector 3 has a male shape which is insertable into the applicable female input tap or female input data port of the junction device 33. The two output ports of the junction device 33 are male-shaped, and the female-type connectors 2 receive, and connect to, such male-shaped output data ports.

In one embodiment, each input tap or input data port of the entry junction device 33 has an internally threaded wall configured to be threadably engaged with one of the male-type connectors 3. The network 5 is operable to distribute signals through the weatherized coaxial cable 35 to the junction device 33, and then through the male-type connector 3. The junction device 33 splits the signals to the two female-type connectors 2, weatherized by an entry box enclosure, to transmit the signals through the cables 37 and 39, down to the distribution box 32 described below.

In another distribution method, the data service provider operates a series of satellites. The service provider installs an outdoor antenna or satellite dish at the environment 6. The data service provider connects a coaxial cable to the satellite dish. The coaxial cable distributes the RF signals or channels of data into the environment 6.

In one embodiment, the multichannel data network 5 includes a telecommunications, cable/satellite TV ("CATV") network operable to process and distribute different RF signals or channels of signals for a variety of services, including, but not limited to, TV, Internet and voice communication by phone. For TV service, each unique radio frequency or channel is associated with a different TV channel. The set-top unit 22 converts the radio frequencies to a digital format for delivery to the TV. Through the data network 5, the service provider can distribute a variety of types of data, including, but not limited to, TV programs including on-demand videos, Internet service including wireless or WiFi Internet service, voice data distributed through digital phone service or Voice Over Internet Protocol (VoIP) phone service, Internet Protocol TV ("IPTV") data streams, multimedia content, audio data, music, radio and other types of data.

In one embodiment, the multichannel data network 5 is operatively coupled to a multimedia home entertainment network serving the environment 6. In one example, such multimedia home entertainment network is the Multimedia over Coax Alliance ("MoCA") network. The MoCA network increases the freedom of access to the data network 5 at various rooms and locations within the environment 6. The MoCA network, in one embodiment, operates on cables 4 within the environment 6 at frequencies in the range 1125 MHz to 1675 MHz. MoCA compatible devices can form a private network inside the environment 6.

In one embodiment, the MoCA network includes a plurality of network-connected devices, including, but not limited to: (a) passive devices, such as the PoE filter 8, internal filters, diplexers, traps, line conditioners, and signal splitters such as described herein comprising any of the splitter transformer 117 embodiments illustrated in FIGS. 1A-6D, which may be disposed within the MoCA network; and (b) active devices, such as amplifiers. The PoE filter 8 provides security against the unauthorized leakage of a user's signal or network service to an unauthorized party or non-serviced environment. Other devices, such as line conditioners, are operable to adjust the incoming signals for better quality of service. For example, if the signal levels sent to the set-top box 22 do not meet designated flatness requirements, a line conditioner can adjust the signal level to meet such requirement.

In one embodiment, the modem 16 includes a monitoring module. The monitoring module continuously or periodically monitors the signals within the MoCA network. Based on this monitoring, the modem 16 can report data or information back to the headend system 26. Depending upon the embodiment, the reported information can relate to network problems, device problems, service usage or other events.

At different points in the network 5, cables 4 and 29 can be located indoors, outdoors, underground, within conduits, above ground mounted to poles, on the sides of buildings and within enclosures of various types and configurations. Cables 29 and 4 can also be mounted to, or installed within, mobile environments, such as land, air and sea vehicles. The cables themselves may be exposed to energies and other signals that induce spurious transient noise signals into the cables and which are transmitted along the cables to connected devices and circuits.

As described above, the data service provider uses coaxial cables 29 and 4 to distribute the data to the environment 6. The environment 6 has an array of coaxial cables 4 at different locations. The female-type connectors 2 are attachable to the coaxial cables 4. The cables 4, through use of the female-type connectors 2, are connectable to various communication interfaces within the environment 6, such as the male interface ports 14 illustrated in FIGS. 7-8. In the examples shown, male interface ports 14 are incorporated into: (a) a signal splitter within an outdoor cable service or distribution box 32 which distributes data service to multiple homes or environments 6 close to each other; (b) a signal splitter within the outdoor cable junction box or cable junction device 10 which distributes the data service into the environment 6; (c) the set-top unit 22; (d) the TV 24; (e) wall-mounted jacks, such as a wall plate; and (f) the router 18.

Figure 8:
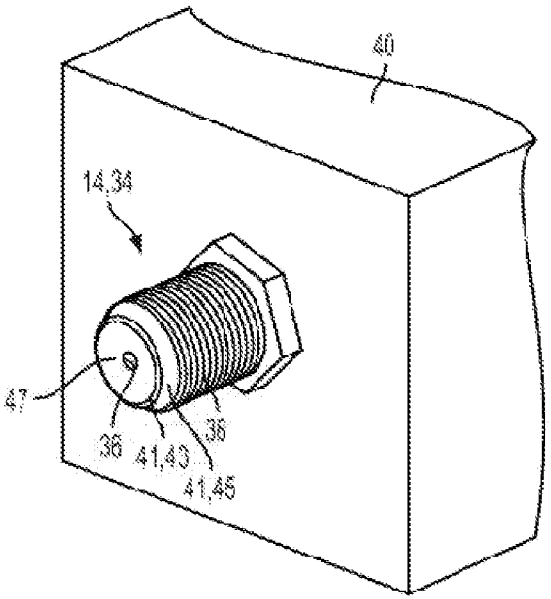
FIG. 8 is an isometric view of one embodiment of a male interface port which is configured to be operatively coupled to the multichannel data network.
Figure 10:
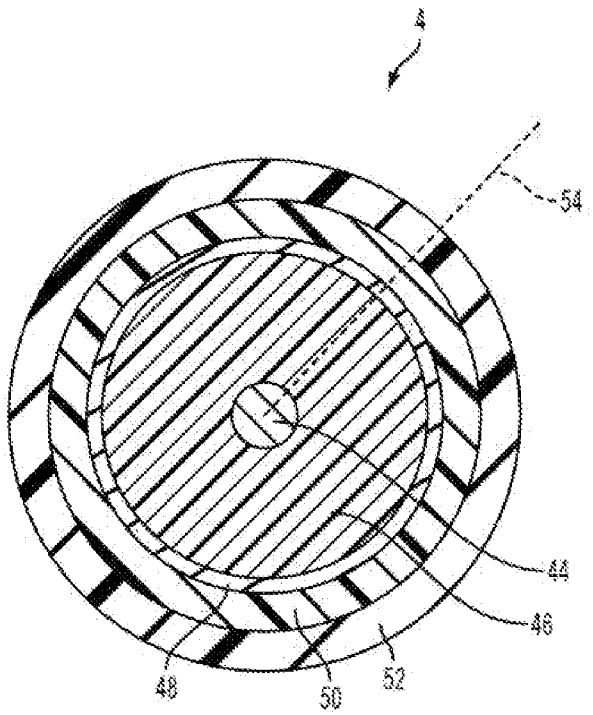
FIG. 10 is a cross-sectional view of the cable of FIG. 9, taken substantially along line 4-4.

In one embodiment, each of the male interface ports 14 includes a stud or male jack, such as the male stud 34 illustrated in FIG. 8. The male stud 34 has: (a) an inner, cylindrical wall 36 defining a central hole configured to receive an electrical contact, wire or conductor (not shown) positioned within the central hole; (b) a conductive, threaded outer surface 38; (c) a conical conductive region 41 having conductive contact sections 43 and 45; and (d) a dielectric or insulation material 47.

In one embodiment, male stud 34 is shaped and sized to be compatible with the F-type coaxial connection standard. It should be understood that, depending upon the embodiment, male stud 34 could have a smooth outer surface. The male stud 34 can be operatively coupled to, or incorporated into, a device 40 which can include, for example, a cable splitter of a distribution box 32, outdoor cable junction box 10 or service panel 12; a set-top unit 22; a TV 24; a wall plate; a modem 16; a router 18; or the junction device 33.

During installation, the installer couples a cable 4 to an interface port 14 by screwing or pushing the female-type connector 2 onto the male interface port 34. Once installed, the female-type connector 2 receives the male interface port 34. The female-type connector 2 establishes an electrical connection between the cable 4 and the electrical contact of the male interface port 34.

After installation, the connectors 2 often undergo various forces. For example, there may be tension in the cable 4 as it stretches from one device 40 to another device 40, imposing a steady, tensile load on the female-type connector 2. A user might occasionally move, pull or push on a cable 4 from time to time, causing forces on the female-type connector 2. Alternatively, a user might swivel or shift the position of a TV 24, causing bending loads on the female-type connector 2. As described below, the female-type connector 2 is structured to maintain a suitable level of electrical connectivity despite such forces.

Referring to FIGS. 9-12, the coaxial cable 4 extends along a cable axis or a longitudinal axis 42. In one embodiment, the cable 4 includes: (a) an elongated center conductor or inner conductor 44; (b) an elongated insulator 46 coaxially surrounding the inner conductor 44; (c) an elongated, conductive foil layer 48 coaxially surrounding the insulator 46; (d) an elongated outer conductor 50 coaxially surrounding the foil layer 48; and (e) an elongated sheath, sleeve or jacket 52 coaxially surrounding the outer conductor 50.

The inner conductor 44 is operable to carry data signals to and from the data network 5. Depending upon the embodiment, the inner conductor 44 can be a strand, a solid wire or a hollow, tubular wire. The inner conductor 44 is, in one embodiment, constructed of a conductive material suitable for data transmission, such as a metal or alloy including copper, including, but not limited, to copper-clad aluminum ("CCA"), copper-clad steel ("CCS") or silver-coated copper-clad steel ("SCCCS").

The insulator 46, in one embodiment, is a dielectric having a tubular shape. In one embodiment, the insulator 46 is radially compressible along a radius or radial line 54, and the insulator 46 is axially flexible along the longitudinal axis 42. Depending upon the embodiment, the insulator 46 can be a suitable polymer, such as polyethylene ("PE") or a fluoropolymer, in solid or foam form.

Figure 9:
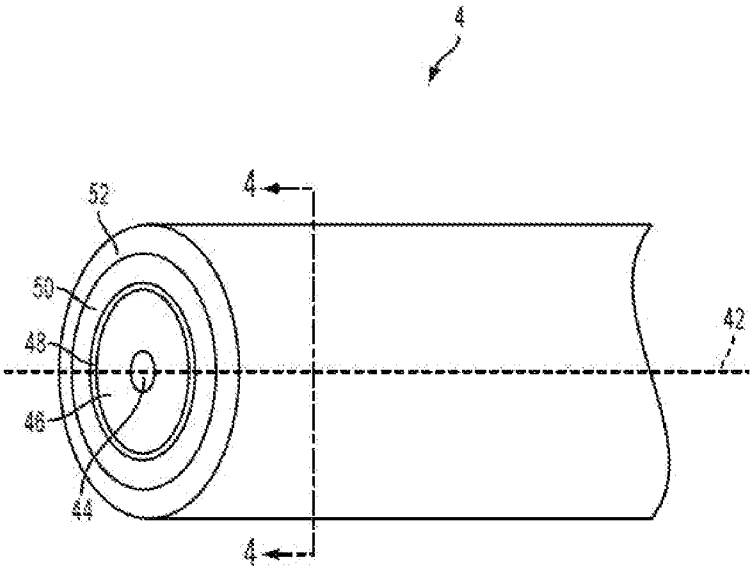
FIG. 9 is an isometric view of one embodiment of a coaxial cable which is configured to be operatively coupled to the multichannel data network.

In the embodiment illustrated in FIG. 9, the outer conductor 50 includes a conductive RF shield or electromagnetic radiation shield. In such embodiment, the outer conductor 50 includes a conductive screen, mesh or braid or otherwise has a perforated configuration defining a matrix, grid or array of openings. In one such embodiment, the braided outer conductor 50 has an aluminum material or a suitable combination of aluminum and polyester. Depending upon the embodiment, cable 4 can include multiple, overlapping layers of braided outer conductors 50, such as a dual-shield configuration, tri-shield configuration or quad-shield configuration.

In one embodiment, as described below, the female-type connector 2 electrically grounds the outer conductor 50 of the coaxial cable 4. When the inner conductor 44 and external electronic devices generate magnetic fields, the grounded outer conductor 50 sends the excess charges to ground. In this way, the outer conductor 50 cancels all, substantially all or a suitable amount of the potentially interfering magnetic fields. Therefore, there is less, or an insignificant, disruption of the data signals running through inner conductor 44. Also, there is less, or an insignificant, disruption of the operation of external electronic devices near the cable 4.

In such embodiment, the cable 4 has two electrical grounding paths. The first grounding path runs from the inner conductor 44 to ground. The second grounding path runs from the outer conductor 50 to ground. The conductive foil layer 48, in one embodiment, is an additional, tubular conductor which provides additional shielding of the magnetic fields. In one embodiment, the foil layer 48 includes a flexible foil tape or laminate adhered to the insulator 46, assuming the tubular shape of the insulator 46. The combination of the foil layer 48 and the outer conductor 50 can suitably block undesirable radiation or signal noise from leaving the cable 4. Such combination can also suitably block undesirable radiation or signal noise from entering the cable 4. This can result in an additional decrease in disruption of data communications through the cable 4 as well as an additional decrease in interference with external devices, such as nearby cables and components of other operating electronic devices.

In one embodiment, the jacket 52 has a protective characteristic, guarding the cable's internal components from damage. The jacket 52 also has an electrical insulation characteristic. In one embodiment, the jacket 52 is compressible along the radial line 54 and is flexible along the longitudinal axis 42. The jacket 52 is constructed of a suitable, flexible material such as polyvinyl chloride (PVC) or rubber. In one embodiment, the jacket 52 has a lead-free formulation including black-colored PVC and a sunlight resistant additive or sunlight resistant chemical structure.

Figure 11:
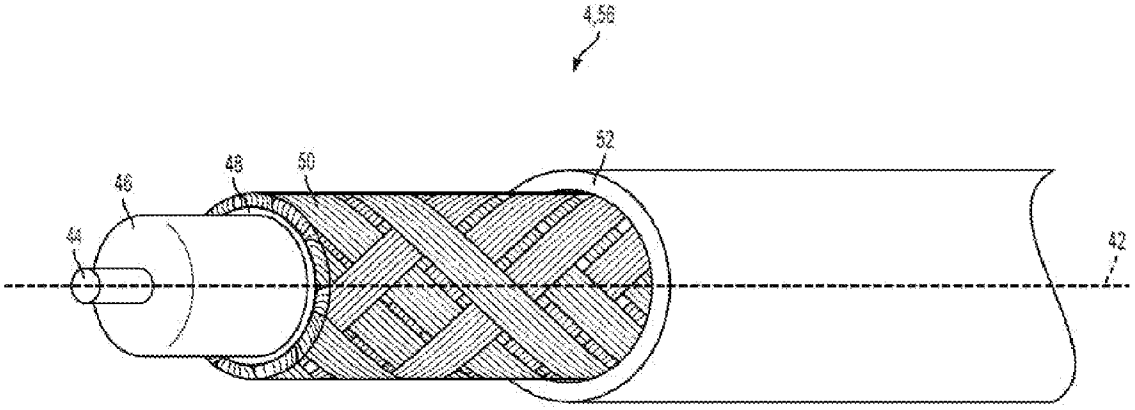
FIG. 11 is an isometric view of one embodiment of a coaxial cable which is configured to be operatively coupled to the multichannel data network, illustrating a three step shaped configuration of a prepared end of the coaxial cable.
Figure 12:
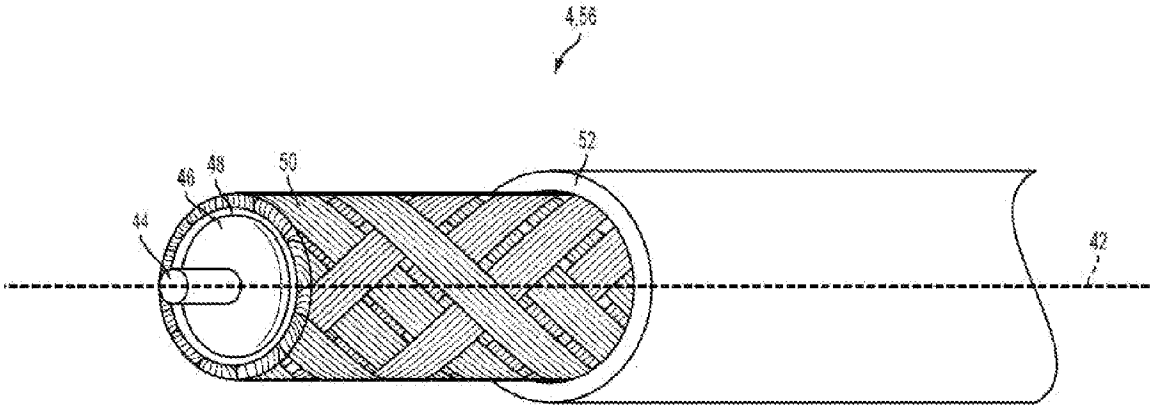
FIG. 12 is an isometric view of one embodiment of a coaxial cable which is configured to be operatively coupled to the multichannel data network, illustrating a two step shaped configuration of a prepared end of the coaxial cable.

Referring to FIGS. 11-12, in one embodiment an installer or preparer prepares a terminal end 56 of the cable 4 so that it can be mechanically connected to the female-type connector 2. To do so, the preparer removes or strips away differently sized portions of the jacket 52, outer conductor 50, foil 48 and insulator 46 so as to expose the side walls of the jacket 52, outer conductor 50, foil layer 48 and insulator 46 in a stepped or staggered fashion. In the example shown in FIG. 11, the prepared end 56 has a three step-shaped configuration. In the example shown in FIG. 12, the prepared end 58 has a two step-shaped configuration. The preparer can use cable preparation pliers or a cable stripping tool to remove such portions of the cable 4. At this point, the cable 4 is ready to be connected to the female-type connector 2.

Figure 13:
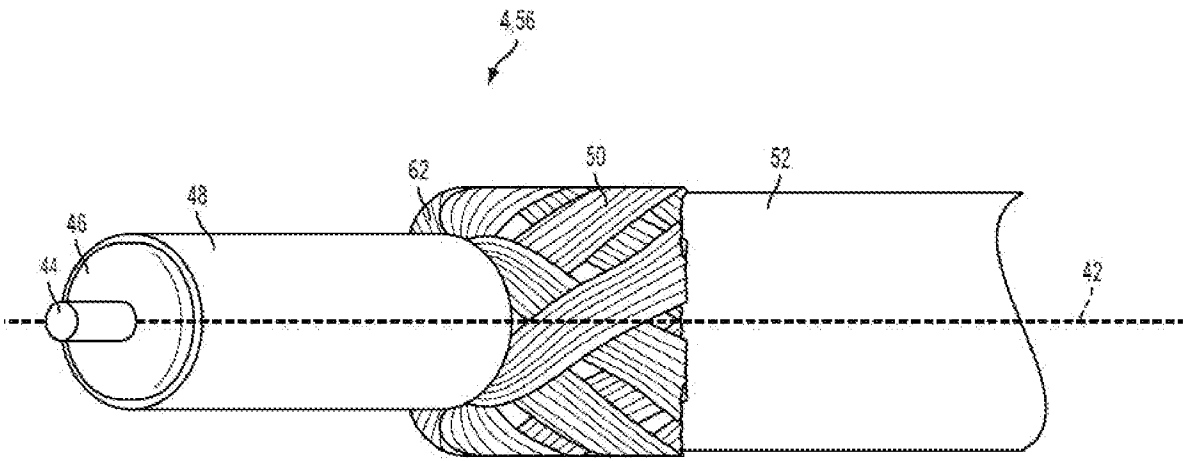
FIG. 13 is an isometric view of one embodiment of a coaxial cable which is configured to be operatively coupled to the multichannel data network, illustrating the folded-back, braided outer conductor of a prepared end of the coaxial cable.

In one embodiment illustrated in FIG. 13, the installer or preparer performs a folding process to prepare the cable 4 for connection to female-type connector 2. In the example illustrated, the preparer folds the braided outer conductor 50 backward onto the jacket 52. As a result, the folded section 60 is oriented inside out. The bend or fold 62 is adjacent to the foil layer 48 as shown. Certain embodiments of the female-type connector 2 include a tubular post. In such embodiments, this folding process can facilitate the insertion of such post in between the braided outer conductor 50 and the foil layer 48.

Depending upon the embodiment, the components of the cable 4 can be constructed of various materials which have some degree of elasticity or flexibility. The elasticity enables the cable 4 to flex or bend in accordance with broadband communications standards, installation methods or installation equipment. Also, the radial thicknesses of the cable 4, the inner conductor 44, the insulator 46, the conductive foil layer 48, the outer conductor 50 and the jacket 52 can vary based upon parameters corresponding to broadband communication standards or installation equipment.

Figure 14:
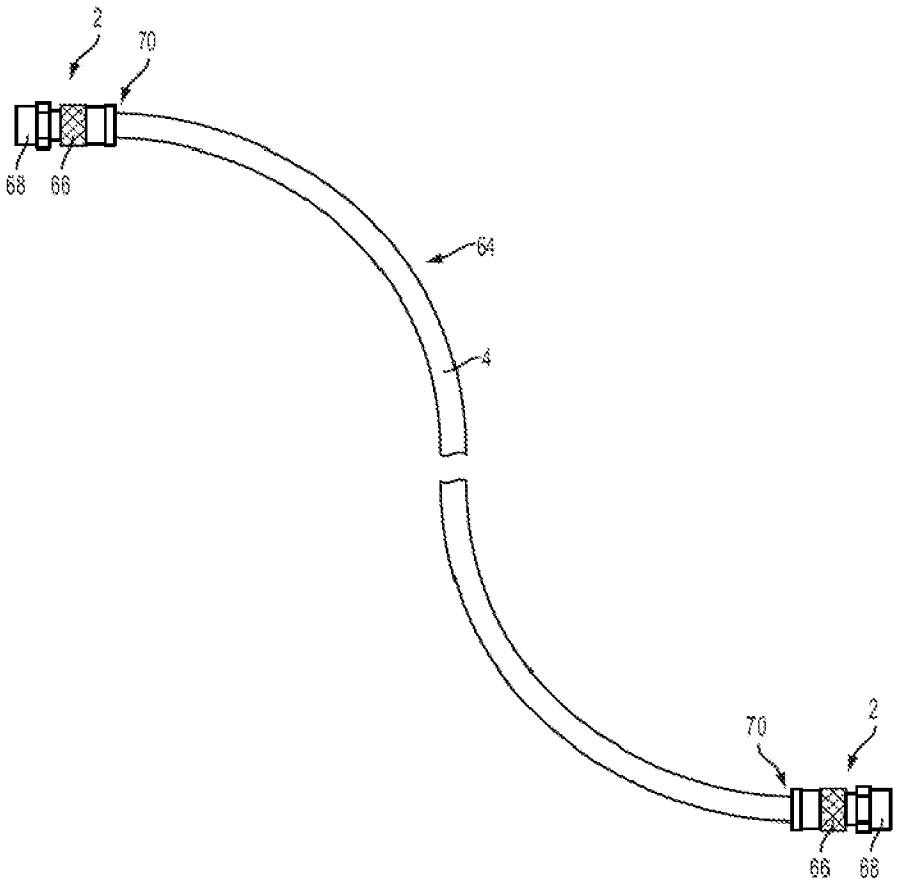
FIG. 14 is a top view of one embodiment of a coaxial cable jumper or cable assembly which is configured to be operatively coupled to the multichannel data network.

In one embodiment illustrated in FIG. 14, a cable jumper or cable assembly 64 includes a combination of the female-type connector 2 and the cable 4 attached to the female-type connector 2. In this embodiment, the female-type connector 2 includes: (a) a connector body or connector housing 66; and (b) a fastener or coupler 68, such as a threaded nut, which is rotatably coupled to the connector housing 66. The cable assembly 64 has, in one embodiment, connectors 2 on both of its ends 70. Preassembled cable jumpers or cable assemblies 64 can facilitate the installation of cables 4 for various purposes.

In one embodiment the weatherized coaxial cable 29, illustrated in FIG. 7, has the same structure, configuration and components as coaxial cable 4 except that the weatherized coaxial cable 29 includes additional weather protective and durability enhancement characteristics. These characteristics enable the weatherized coaxial cable 29 to withstand greater forces and degradation factors caused by outdoor exposure to weather.

Depending upon the embodiment, each demagnetizing device 118, 318, 418, 518, 618, can be operatively coupled to, or incorporated into any network-connected device that is physically or operatively connected to the data network 5, including, but not limited to, the PoE filter 8, entry junction box 33, a signal splitter within an outdoor cable service or distribution box 32 which distributes data service to multiple homes or environments 6 close to each other, a signal splitter within the outdoor cable junction box or cable junction device 10 which distributes the data service into the environment 6, a ground isolator, the set-top unit 22, the TV 24, wall-mounted jacks, such as a wall plate, and the router 18, or any other device having a ferrite core or iron core, such as a transformer.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. A demagnetizing device comprising:

a circuit configured to be operatively coupled to an apparatus, the apparatus comprising a first signal circuit portion and at least one ferrite component, the apparatus being electrically connected to a coaxial cable that transmits data signals, the coaxial cable being electrically connected to a data network, wherein the first signal circuit portion is configured to receive a first parallel part of a transient signal and the data signals, and the first parallel part of the transient signal is operable to magnetize the at least one ferrite component, the magnetization being operable to cause a performance of the apparatus to drop from a designated performance level to a lower performance level with respect to receiving and transmitting the data signals, wherein the circuit comprises a second signal circuit portion and a demagnetizing coil, the second signal circuit portion configured to receive a second parallel part of the transient signal in parallel with the first signal circuit portion receiving the first parallel part of the transient signal, the demagnetizing coil configured to operate based on the second parallel part of the transient signal, the demagnetizing coil being operable to cause a continuous reduction in the magnetization of the at least one ferrite component so that the performance of the apparatus is maintained to be at least as good as the designated performance level with respect to receiving and transmitting the data signals.

2. The demagnetizing device of claim 1, wherein the ferrite component comprises a splitter transformer.

3. The demagnetizing device of claim 1, wherein first signal circuit portion and the second signal circuit portion are connected in parallel to the coaxial cable.

4. The demagnetizing device of claim 1, wherein the ferrite component is mounted to a PCB and wherein the demagnetizing coil is oriented such that a plane of the coil is parallel to a plane of the PCB.

5. The demagnetizing device of claim 4, wherein the ferrite component is disposed in a center of the demagnetizing coil.

6. The demagnetizing device of claim 1, wherein the ferrite component is mounted to a PCB and wherein the demagnetizing coil is oriented such that a plane of the coil is perpendicular to a plane of the PCB.

7. The demagnetizing device of claim 6, wherein the ferrite component is disposed proximate a center of the demagnetizing coil.

8. A demagnetizing device comprising:

a circuit configured to be operatively coupled to an apparatus, the apparatus comprising a first circuit portion and at least one component, the apparatus being electrically connectable to a coaxial cable, the coaxial cable being electrically connectable to a data network, wherein the first circuit portion is configured to receive a first parallel part of a transient signal and the first parallel part of the transient signal is operable to magnetize the at least component, the magnetization being operable to cause a performance of the apparatus to drop from a designated performance level to a lower performance level, wherein the circuit comprises a second circuit portion and a demagnetizer, the second circuit portion configured to receive a second parallel part of the transient signal in parallel with the first circuit portion receiving the first parallel part of the transient signal, the demagnetizer configured to operate based on the second parallel part of the transient signal, the operation of the demagnetizer being operable to cause a continuous reduction in the magnetization of the at least one component so that the performance of the apparatus is maintained to be at least as good as the designated performance level.

9. The demagnetizing device of claim 8, wherein the demagnetizer comprises a permanent magnet.

10. The demagnetizing device of claim 8, wherein the demagnetizer comprises a conductive coil.

11. The demagnetizing device of claim 10, wherein the second parallel part of the transient signal induces a magnetic field in the conductive coil, and wherein the magnetic field is operable to cause the continuous reduction in the magnetization of the at least one component.

12. The demagnetizing device of claim 10, wherein the conductive coil at least partially surrounds the at least one component.

13. A circuit comprising:

a first component configured to receive a transient signal and comprising a ferromagnetic material;

a second component configured to receive the transient signal;

wherein:

the ferromagnetic material is subject to a magnetization caused by the transient signal received by the first component; and the second component is configured to emit a counteracting signal in response to receiving the transient signal, the counteracting signal being configured to cause a reduction in the magnetization of the ferromagnetic material in the first component.

14. The circuit of claim 13, wherein the second component comprises a source of a magnetic field.

15. The circuit of claim 14, wherein the source of the magnetic field comprises a conductive coil.

16. The circuit of claim 15, wherein the counteracting signal comprises the magnetic field.

17. The circuit of claim 16, wherein the source of the magnetic field is configured to demagnetize the first component via the magnetic field.

18. The circuit of claim 17, wherein the transient signal induces the magnetic field to be generated by the conductive coil.

19. The circuit of claim 13, wherein the conductive coil is disposed to surround the first component.

20. The circuit of claim 13, wherein:

the circuit is configured to communicate data signals with a data network;

the magnetization is operable to reduce performance of the circuit from a designated performance level to a lower performance level with respect to the communication of the data signals; and the second component comprises a demagnetizing coil configured continuously reduce the magnetization of the ferromagnetic material such that the performance of the circuit is maintained to be at least as good as the designated performance level with respect to the communication of the data signals.

* * * * *